US005911382A

United States Patent [19]

Wilson

[11] Patent Number: 5,911,382

[45] Date of Patent: Jun. 15, 1999

[54] AUXILIARY PRINTING MEDIA ROLL HOLDER FOR PRINTER/PLOTTERS

[75] Inventor: Bruce Wilson, Houston, Tex.

[73] Assignee: David M. Lee, Houston, Tex.

[21] Appl. No.: 08/986,915

[22] Filed: Dec. 8, 1997

[51] Int. Cl.[6] ..... B65H 23/16

[52] U.S. Cl. ..... 242/419.6; 242/422.5; 242/578.2; 242/598.4; 101/228

[58] Field of Search ..... 242/422.5, 578, 242/578.2, 598, 598.3, 598.4, 599.3, 419.6; 101/181, 228

[56] References Cited

U.S. PATENT DOCUMENTS

| | | | |
|---|---|---|---|
| 2,107,020 | 2/1938 | Williams | 242/578.2 |
| 2,250,494 | 7/1941 | Nyberg et al. | 242/578.2 |
| 2,328,102 | 8/1943 | Schmitt | 242/598.4 X |
| 2,596,428 | 5/1952 | O'Malley | 242/598.3 X |
| 3,411,734 | 11/1968 | Greenberg et al. | 242/599.3 |
| 3,792,825 | 2/1974 | Kampf . | |
| 4,014,426 | 3/1977 | Neufeld | 242/598.4 X |
| 4,277,034 | 7/1981 | Buzzell . | |
| 4,792,105 | 12/1988 | Imaseki | 242/599.3 X |
| 4,821,874 | 4/1989 | Poehlein . | |
| 5,327,168 | 7/1994 | Oda . | |
| 5,363,129 | 11/1994 | Kline et al. . | |
| 5,392,676 | 2/1995 | Drury | 242/598 X |
| 5,530,459 | 6/1996 | Kline et al. . | |
| 5,551,647 | 9/1996 | Browning | 242/578.2 |
| 5,632,455 | 5/1997 | Stein . | |
| 5,651,510 | 7/1997 | Eble et al. | 242/599.3 X |

FOREIGN PATENT DOCUMENTS

| | | | |
|---|---|---|---|
| 540886 | 1/1932 | Germany | 242/578.2 |
| 568096 | 10/1957 | Italy | 242/422.5 |

OTHER PUBLICATIONS

Color Photocopy of Techniprint, Inc. Internet Web Page, Showing "Universal Adapter" Dec. 1997.

*Primary Examiner*—Donald P. Walsh
*Assistant Examiner*—William A. Rivera
*Attorney, Agent, or Firm*—Kenneth A. Roddy

[57] ABSTRACT

An auxiliary printing media roll holder use with printer/plotters to accomodate a large feed roll of printing media and increase the printing/plotting capacity and operational efficiency of the printer/plotter and reduce downtime due to reloading printing media rolls. The auxiliary roll holder has an elongate longitudinal frame with opposed ends adapted to be mounted between the laterally spaced legs that support the printer/plotter, longitudinal rollers rotatably mounted on the frame in parallel spaced relation, a longitudinal spindle bar removably received and rotatably engaged at opposed ends on the frame, and a pair of hubs slidably received and releasably secured on the spindle bar near its opposed ends, each having a generally cylindrical core receiving portion disposed in opposed facing relation for engaging and supporting opposed ends of a tubular core of a large roll of printing media which is drawn from the roll, passes over the roller, and into the printer/plotter. A weight bar engages the printing media and applies and maintains tension on the printing media to keep it taut and prevent it from unrolling when feeding stops and as resistance of the rolled printing media becomes lighter as it reaches the end of the roll. The auxiliary printing media roll holder also receives and supports a paper catcher that receives the printing media as it exits the printer/plotter. In a preferred embodiment the auxiliary roll holder will acomodate a 500 linear foot roll of printing media.

12 Claims, 5 Drawing Sheets

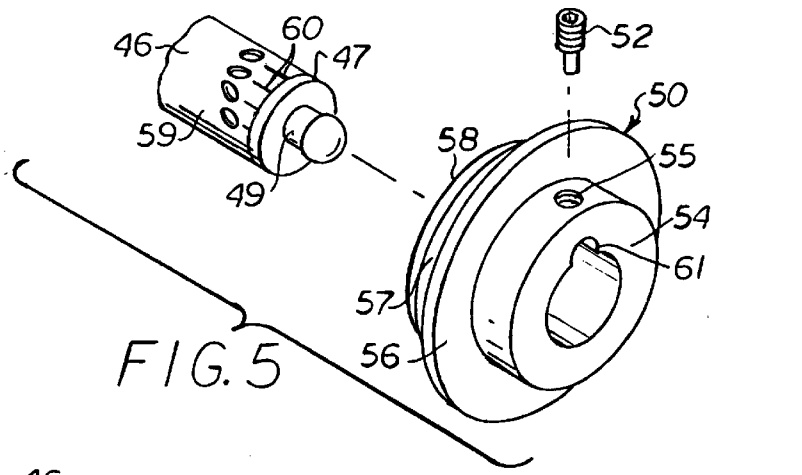
FIG. 5
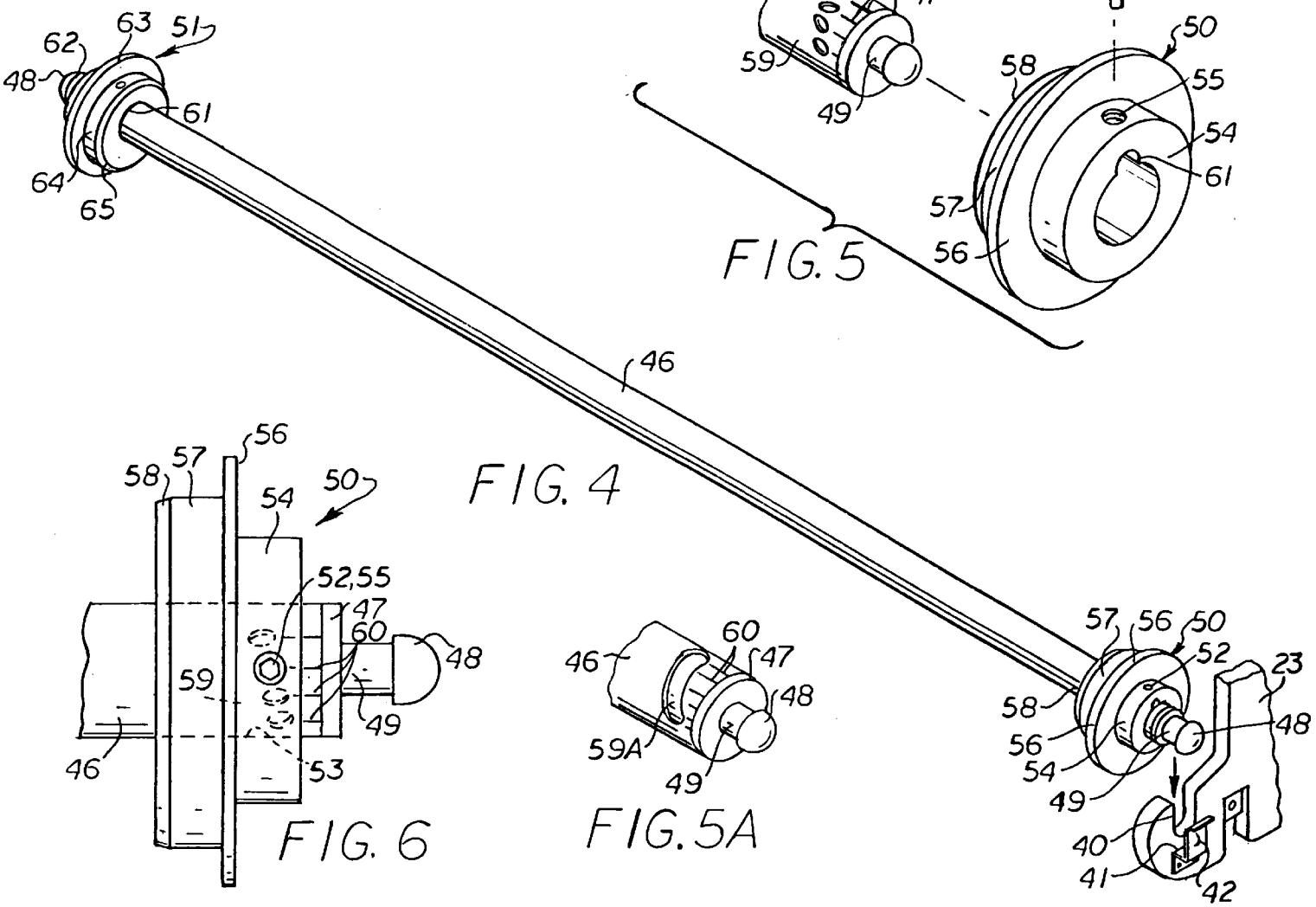
FIG. 4
FIG. 5A
FIG. 6

AUXILIARY PRINTING MEDIA ROLL HOLDER FOR PRINTER/PLOTTERS

BACKGROUND OF THE INVENTION

1. Field of the Invention

This invention relates generally to printing media roll holders for computer driven printer/plotters of the type that produce engineering or other large drawings on paper, vellum, film or other printing media which is drawn through the mechanism from a roll, and more particularly to an auxiliary printing media roll holder for attachment to such printer/plotters to accomodate large rolls of feed printing media and increase the printing/plotting capacity and operational efficiency and reduce downtime due to reloading feed printing media rolls.

2. Brief Description of the Prior Art

Commercially available inkjet printers and plotters have a built-in feed paper roller which is contained in a housing at the front end of the machine on which the printing media is wound. Many popular printer/plotters, such as the Hewlett-Packard HP DesignJet 350 series are designed for low end use and may be supported on a desk for feeding individual sheets of paper and other sheet media or may be supported on an accessory roll-feed and legs unit which has a housing that contains a roll of feed media (150 linear feet) for continuous plotting. Larger printer/plotters, such as the Hewlett-Packard HP DesignJet 650, 750, and 2500 series are designed for high end use, and the roll-feed and legs unit is a standard component of the printer/plotter.

Due to the size constraints of the cabinet or the housing of the roll-feed and legs unit, the diameter of the roll and thus the length of the paper available for use is limited. Most of these printers and plotters, and the feed-roll housing are sized to accomodate a 150 foot roll of feed paper which is approximately 3" in diameter, depending upon the type of paper. While the 150 foot roll of feed paper may be adequate for low end use or for a small business, it is not satisfactory for many larger users.

Although the manufacturers of printers and plotters have attempted to improve the duty cycle, and reduce down-time, they have done so by merely providing larger capacity ink cartridges to increase the ink reservoir so that the user does not run out of ink. Currently, the user will usually run out of paper before depleting the ink supply. For example, the ink supply may be capable of printing or plotting 3,000 linear feet, while the maximum feed paper supply is only be 150 linear feet.

For a user to complete a large plotting job, it may be necessary to replace the roll of feed paper or other media many times before the job is completed. For example, if the printer/plotter has an ink cartridge with a capability of plotting 3,000 linear feet and a 150 foot roll of feed paper, the user must replace the paper roll 20 times before running out of ink, depending of course upon the DPI (dots per inch) of the plotting task.

Loading a new roll of feed paper or other media is not a simple operation, because the paper roll is not simply replaced, the edges of the paper must be precisely re-aligned and the printer/plotter may have to be reset and re-calibrated to recognize the placement of the new paper. With larger printer/plotters, such as the Hewlett-Packard 750 series, re-calibration takes about 10 minutes, and with the HP 2500 series it takes even longer. Thus, excessive down-time and many man hours must be spent merely to reload the feed paper. Some large companies do their plotting jobs in the evenings, and must pay an employee to be present just to reload the feed paper.

In a preferred embodiment the present auxiliary paper roll holder accomodates a 500 foot roll of feed paper. Tests have shown that a Hewlett-Packard 750 series printer/plotter equipped with the present auliliary paper roll holder supporting a 500 foot roll of feed paper will allow the printer/plotter to operate continuously for about 9 hours before requiring a new roll of paper, whereas, the same machine utilizing its existing 150 foot feed paper supply will only operate for about 2 hours and 45 minutes before requiring a new roll of paper. Thus, the auxiliary paper roll holder eliminates 3 shut-down and paper roll change operations to accomplish the same plotting task. The present paper roll holder will allow a user to operate the machine all day or all evening, unattended, to complete large plotting jobs without interruption or down-time.

There are several patents which disclose printers and plotters having a built-in feed paper roller housed in the cabinet of the machine or mounted in an accessory roll-feed and legs kit, and various paper roll holding devices.

Kline et al, U.S. Pat. Nos. 5,363,129 and 5,530,459, assigned to Hewlett-Packard Company, disclose retractable pinch roller feeding and retaining mechanisms which are contained within the chassis of a computer driven printer/plotter of the prior art type discussed above which is supported on a roll-feed and leg unit and has a roll of print media contained inside an arcuate housing at the upper end of the legs, and a U-shaped wire frame paper catcher between the legs that receives the print media as it exits the machine. As discussed above, due to the size constraints of the chassis or housing of the roll feed unit, the diameter of the roll and thus the length of the paper available for use is limited. The present invention is suitable for installation between the support legs of this type of printer/plotter to accomodate a secondary large feed roll of printing media and increase its printing/plotting capacity and operational efficiency and reduce downtime due to reloading the print media rolls contained within the housing, and also to support its existing paper catcher, without modification to the printer/plotter chassis or support leg unit.

Stein, U.S. Pat. No. 5,632,455 discloses a wide-bed plotter supported laterally spaced legs and has a media supply roll and a media take-up roll at the longitudinal sides rotatably mounted at opposed ends inside a housing. The supply and take-up rolls have flanged cylindrical hubs at their outer ends with an inside diameter smaller than the inside diameter of the smallest roll core expected to be supported and a rough surface for rolling engagement with a portion of the inside diameter of the core.

Oda, U.S. Pat. No. 5,327,168 discloses a rolled sheet conveying and route control apparatus for plotters supported between laterally spaced legs that has a media supply roll and a pair of tension rollers to impart weak tension to the print media to prevent snaking, and a manually adjustable threaded mechanism on the tension roller support for adjusting the slant of the rollers to control and equalize the distances of the left and right edges of the print media between the tension rollers and the drive roller.

Poehlein, U.S. Pat. No. 4,821,974 discloses a media supply roll for a large document printer having two end support hubs with compressible springs mounted on opposed axially aligned spindle shafts. The media roll core is seated on tapered surfaces of the hubs and the compression spring allows one end to be urged outward so that, once fully seated against the hub member, one spring predominates and maintains the roll in a precisely aligned axial position.

Buzzell, U.S. Pat. No. 4,277,034 discloses a paper roll holder with a dancer bar for use with printers. An axle is inserted through the core of the supply roll an rotatably supported in a bracket. The paper extends from the supply roll over a resiliently-mounted dancer bar and into the printer.

The present invention is distinguished over the prior art in general, and these patents in particular by an auxiliary printing media roll holder use with printer/plotters to accomodate a large feed roll of printing media and increase the printing/plotting capacity and operational efficiency of the printer/plotter and reduce downtime due to reloading printing media rolls. The auxiliary roll holder has an elongate longitudinal frame with opposed ends adapted to be mounted between the laterally spaced legs that support the printer/plotter, longitudinal rollers rotatably mounted on the frame in parallel spaced relation, a longitudinal spindle bar removably received and rotatably engaged at opposed ends on the frame, and a pair of hubs slidably received and releasably secured on the spindle bar near its opposed ends, each having a generally cylindrical core receiving portion disposed in opposed facing relation for engaging and supporting opposed ends of a tubular core of a large roll of printing media which is drawn from the roll, passes over the roller, and into the printer/plotter. A weight bar engages the printing media and applies and maintains tension on the printing media to keep it taut and prevent it from unrolling when feeding stops and as resistance of the rolled printing media becomes lighter as it reaches the end of the roll. The auxiliary printing media roll holder also receives and supports a paper catcher that receives the printing media as it exits the printer/plotter. In a preferred embodiment the auxiliary roll holder will acomodate a 500 linear foot roll of printing media.

SUMMARY OF THE INVENTION

It is therefore an object of the present invention to provide an auxiliary printing media roll holder for computer driven printer/plotters of the type that produce engineering or other large drawings on paper, vellum, film or other printing media.

It is another object of this invention to provide an auxiliary printing media roll holder which can be easily and quickly attached to existing computer driven printer/plotters.

Another object of this invention is to provide an auxiliary printing media roll holder for computer driven printer/plotters which will accomodate large feed rolls of printing media and increase their printing/plotting capacity and operational efficiency and reduce downtime due to reloading feed printing media rolls.

Another object of this invention is to provide an auxiliary printing media roll holder which can be attached to existing computer driven printer/plotters and will support an existing paper catcher.

Another object of this invention is to provide an auxiliary printing media roll holder for computer driven printer/plotters which will maintain proper tension on the media which is drawn through the mechanism from a roll.

A further object of this invention is to provide an auxiliary printing media roll holder for computer driven printer/plotters which will precisely align the media which is drawn through the mechanism from a roll.

A still further object of this invention is to provide an auxiliary printing media roll holder for computer driven printer/plotters which is rugged and reliable in operation.

Other objects of the invention will become apparent from time to time throughout the specification and claims as hereinafter related.

The above noted objects and other objects of the invention are accomplished by an auxiliary printing media roll holder use with printer/plotters to accomodate a large feed roll of printing media and increase the printing/plotting capacity and operational efficiency of the printer/plotter and reduce downtime due to reloading printing media rolls. The auxiliary roll holder has an elongate longitudinal frame with opposed ends adapted to be mounted between the laterally spaced legs that support the printer/plotter, longitudinal rollers rotatably mounted on the frame in parallel spaced relation, a longitudinal spindle bar removably received and rotatably engaged at opposed ends on the frame, and a pair of hubs slidably received and releasably secured on the spindle bar near its opposed ends, each having a generally cylindrical core receiving portion disposed in opposed facing relation for engaging and supporting opposed ends of a tubular core of a large roll of printing media which is drawn from the roll, passes over the roller, and into the printer/plotter. A weight bar engages the printing media and applies and maintains tension on the printing media to keep it taut and prevent it from unrolling when feeding stops and as resistance of the rolled printing media becomes lighter as it reaches the end of the roll. The auxiliary printing media roll holder also receives and supports a paper catcher that receives the printing media as it exits the printer/plotter. In a preferred embodiment the auxiliary roll holder will acomodate a 500 linear foot roll of printing media.

BRIEF DESCRIPTION OF THE DRAWINGS

FIG. 4 is an isometric view of the spindle bar member of the auxiliary printing media roll holder and a portion of an end plate shown with the guide plate removed for clarity.

FIG. 5 is an exploded isometric view of the right-hand end of the spindle bar and a hub member showing the adjustment holes in the the spindle bar.

FIG. 5A is an exploded isometric view of the right-hand end of the spindle bar having a spiral adjustment groove in the spindle bar.

FIG. 6 is an elevation view of showing the hub member installed over the adjustment holes at the right-hand end of the spindle bar.

DESCRIPTION OF THE PREFERRED EMBODIMENT

In the following description, it should be understood that the terms "paper" and "feed paper" is meant to encompass paper, vellum, film, or other printing media on which engineering or other large drawings are produced.

Figure 1:
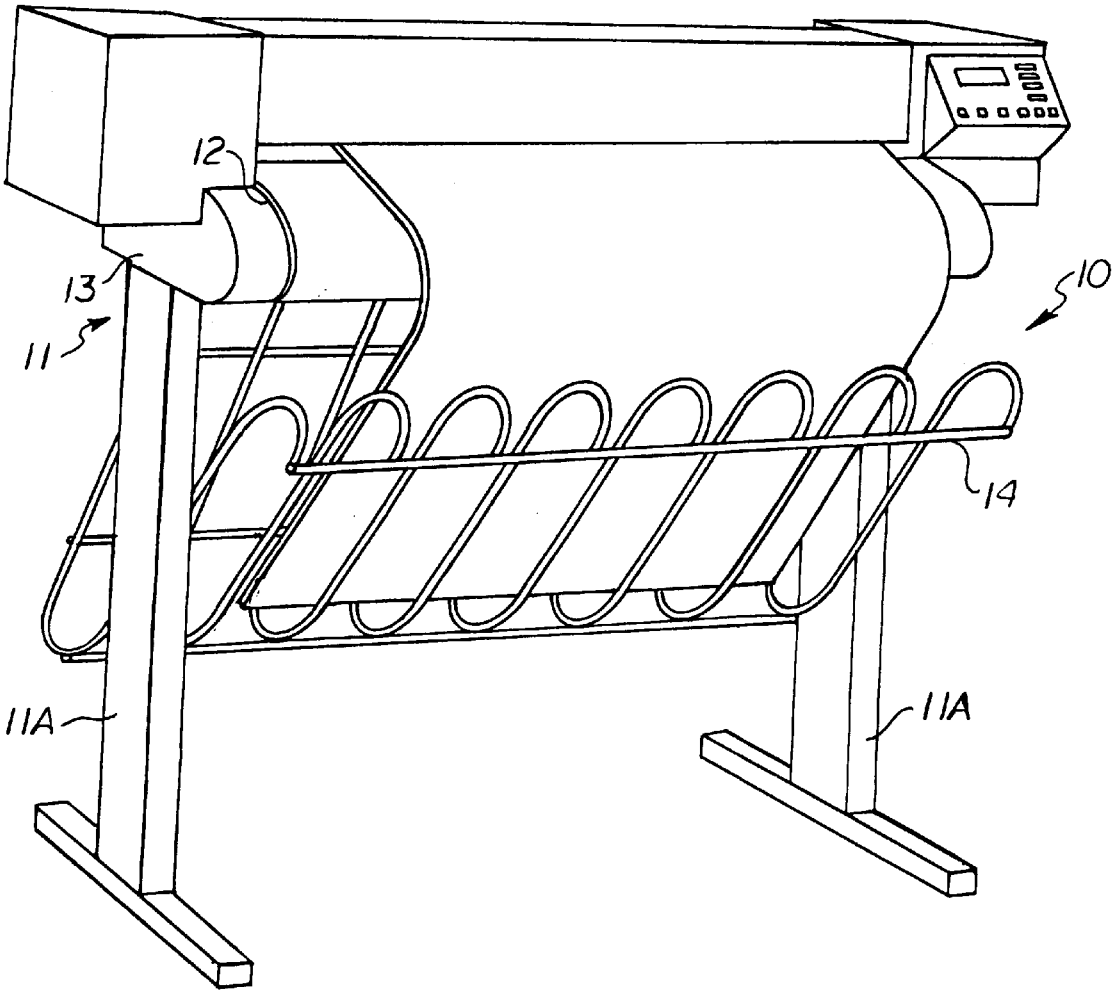
FIG. 1 (PRIOR ART)
FIG. 1 is a perspective view of a conventional printer/plotter of the prior art supported on a roll-feed and legs unit.

Referring to the drawings by numerals of reference, there is shown in FIG. 1, a conventional computer driven printer/plotter 10 of the prior art which is supported on a roll-feed and leg unit 11. The roll of feed paper 12 or other printing media is mounted inside a housing 13 at the upper end of the roll-feed and leg unit. A generally U-shaped wire frame paper catcher 14 that receives the paper or other printing media as it exits the machine extends transversely between the legs 11A and is attached at each side by screws to the legs 11A and the upper ends of the rear portion of the U-shaped wire members are releasably attached along a crossbar extending between the support legs beneath the housing.

Figure 2:
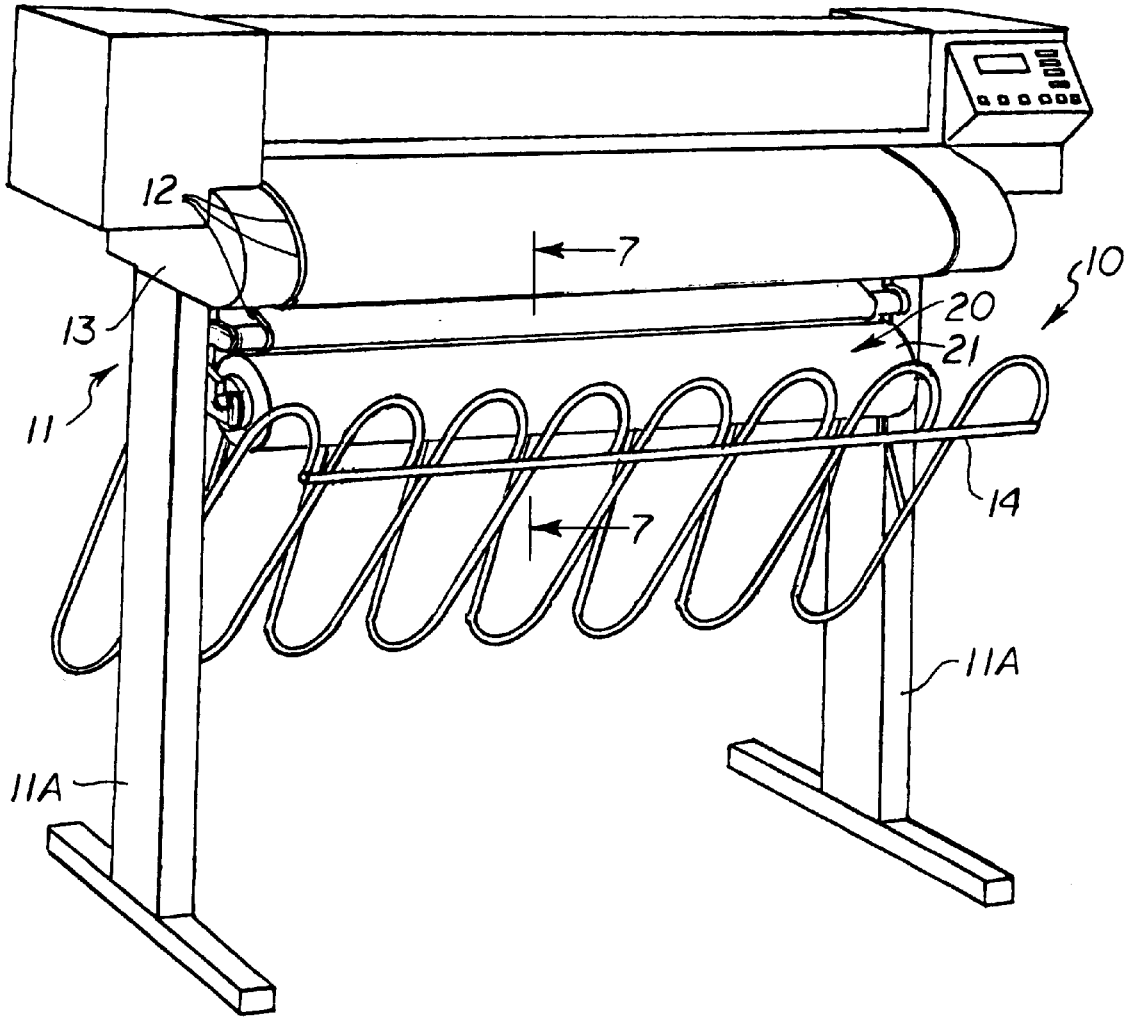
FIG. 2 is a perspective view of the auxiliary printing media roll holder in accordance with the present invention installed on the roll-feed and legs unit of the prior art printer/plotter.

FIG. 2 shows the same prior art printer/plotter 10 with a preferred embodiment of the present auxiliary printing media roll holder 20 attached between the legs 11A on which the printer/plotter is supported. As explained in detail hereinafter, the existing wire frame paper catcher 14 is removed and the auxiliary printing media roll holder 20 is mounted between the legs 11A utilizing the existing mounting holes for the wire frame paper catcher 13. When the auxiliary printing media roll holder 20 is installed, the paper catcher 14 is supported by the auxiliary printing media roll holder 20. The auxiliary printing media roll holder 20 accomodates a large roll 21 of feed paper, preferably a 500 foot roll of feed paper or other printing media.

Figure 3:
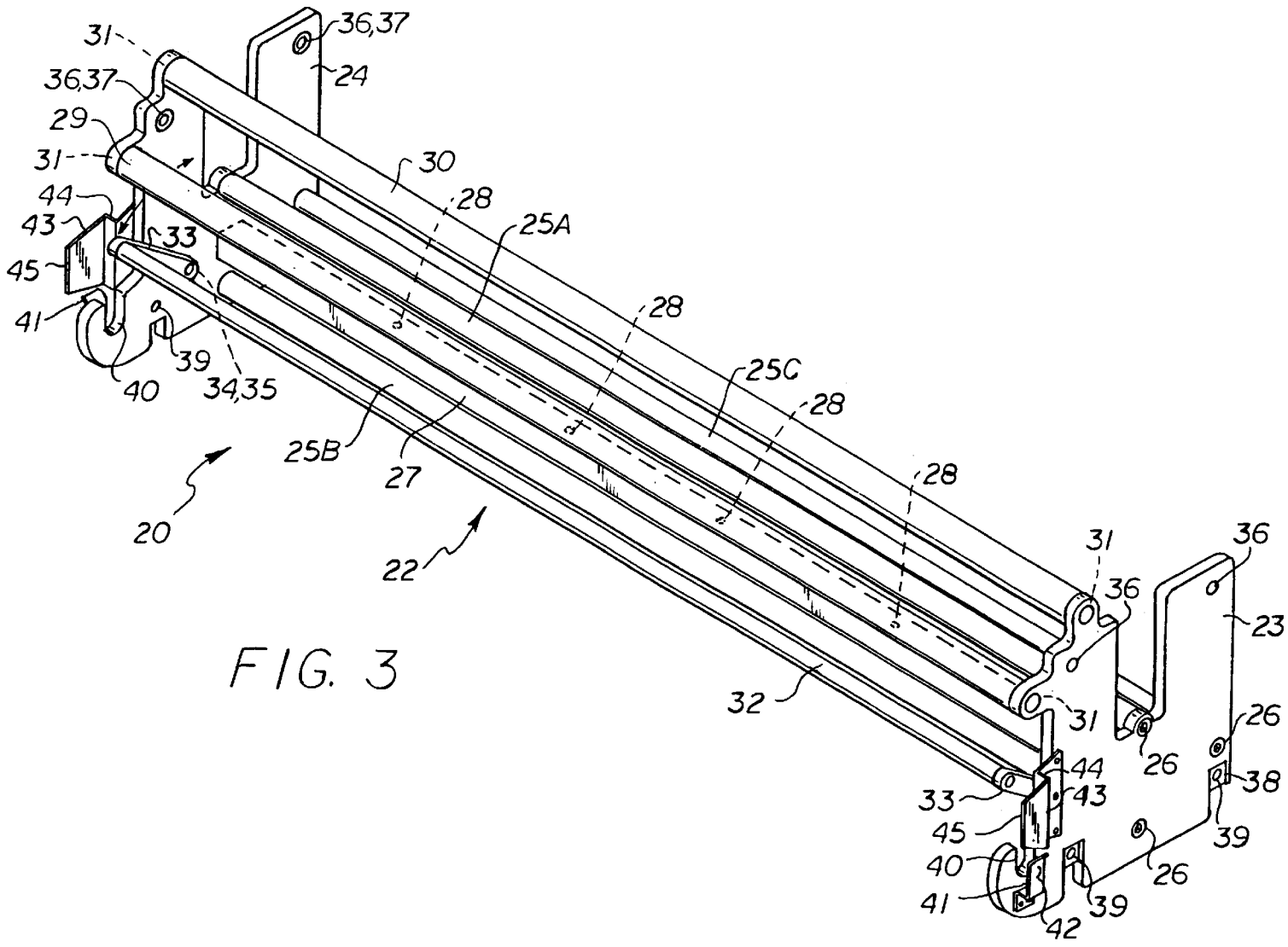
FIG. 3 is an isometric view of the present auxiliary printing media roll holder shown with the spindle bar removed from the end plates for clarity.
Figure 7:
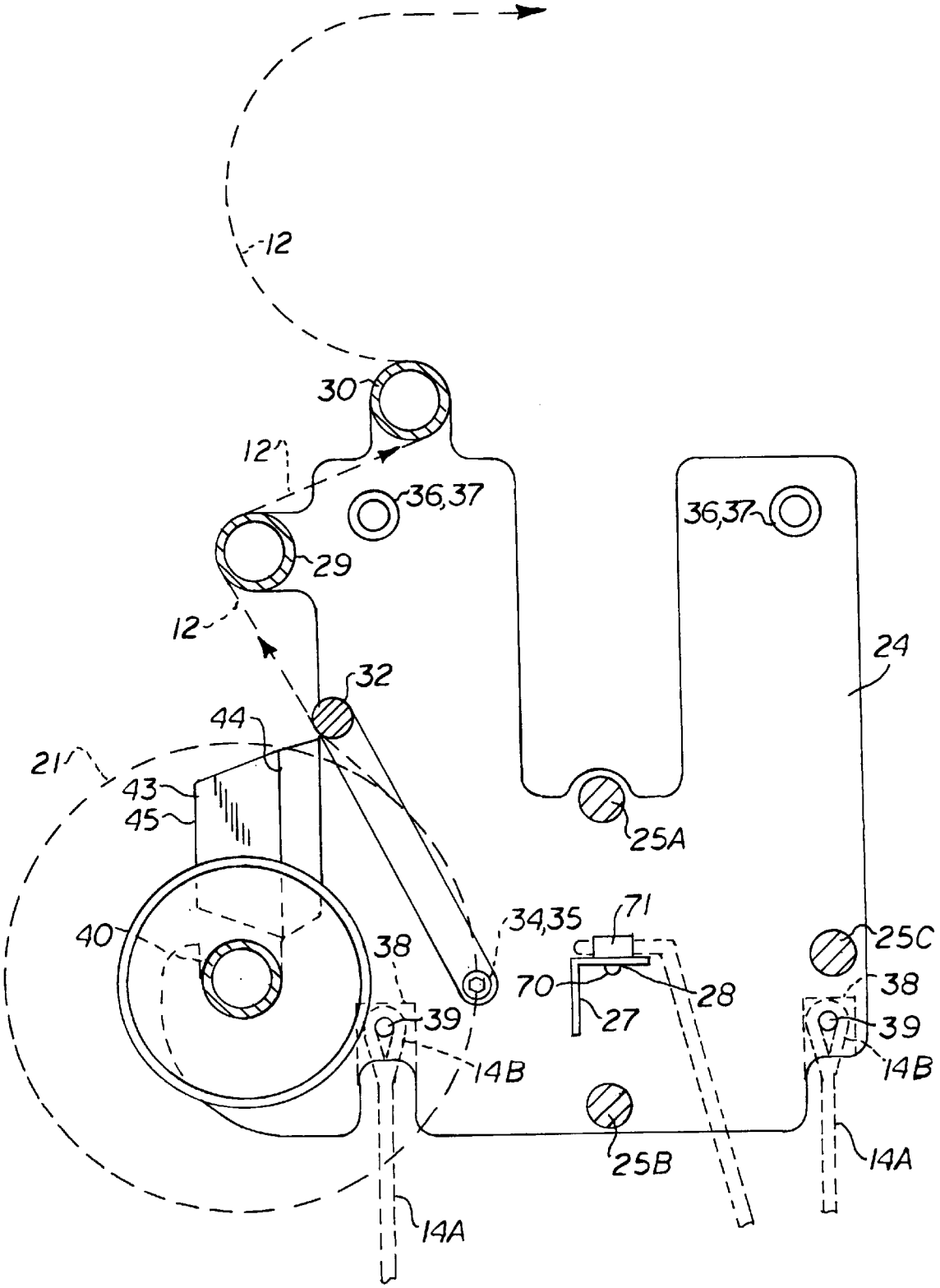
FIG. 7 is a transverse cross section through the assembled auxiliary printing media roll holder taken along line 7—7 of FIG. 2, showing the path of the feed paper as it passes over the rollers of the holder.

As shown in FIGS. 3 and 7, the auliliary printing media roll holder 20 has a frame 22 formed of two end plates 23 and 24 connected together in laterally opposed spaced relation by three metal spacer bars 25A, 25B and 25C of predetermined length with cap screws 26 that extend through the end plates and into the ends of the spacer bars. The spacer bars 25A–25C are disposed in a generally triangular pattern with two vertically spaced bars 25A and 25B near the midsection of the plates 23 and 24 and one bar disposed at the rear of the plates. The spacer bars 25A–25C determine the longitudinal distance between the endplates 23 and 24 and maintain the end plates perpendicular to the longitudinal axis of the frame.

An inverted L-shaped angle member 27 extends transversely between the end plates 23 and 24 and is secured at each end to the inner face of each end plate. The horizontal leg of the angle member 27 is provided with a plurality of longitudinally spaced holes 28.

A first longitudinal tubular roller 29 is rotatably mounted between the end plates 23 and 24 at their front edge and a second longitudinal tubular roller 30 is rotatably mounted between the end plates at their upper edge a distance above and rearwardly of the first roller. In a preferred embodiment, the rollers 29 and 30 are formed of metal and are anodized or otherwise provided with a surface finish which will not contaminate the feed paper or other printing media as it passes over the rollers. The rollers 29 and 30 are journalled at each end in bearings 31 in the end plates. The bearings 31 may be formed of a polymer or other suitable material to provide long-lasting, smooth, and quiet rotational movement.

A metal weight bar 32 extends transversely between the end plates 23 and 24 and is secured at each end to the upper end of a pair of pivot arms 33 that are pivotally connected at their lower end to inner face of the end plates. In a preferred embodiment, the weight bar 32 is of a given weight and the pivot arms are of a length sufficient to constantly rest on the roll of feed printing media beneath the first roller and maintain a predetermined amount of tension on the printing media to keep it taut and prevent it from becoming slack or unrolling when the feeding stops and as the resistance on the printing media becomes lighter as it reaches the end of the roll. A bushing 34 of low friction material is disposed between the end plate surface and the outer side of each pivot arm and a low friction washer 35 is disposed on their inner sides at the pivotal mounting to provide long-lasting, smooth, and quiet pivotal movement.

Each end plate 23 and 24 has a pair of laterally spaced holes 36 near its upper end that are counterbored from the inner face of the plate to receive mounting screws. Bushings 37 of low friction material are slidably installed in the counterbores of the holes 36 on the left-hand end plate 24 and through which the mounting screws pass. Each end plate 23 and 24 has a pair of shallow laterally spaced rectangular grooves 38 formed in its outer face extending vertically upwardly from its bottom edge and a threaded screw hole 39 extend through each plate at the upper end of each groove to receive a mounting screw.

Each end plate 23 and 24 has a vertical slot 40 with a rounded bottom near its front bottom edge. A spring steel clip 41 is mounted on the outer face of each end plate 23 and 24 and has an L-shaped upper portion disposed a short distance outwardly from the vertical slot 40. The top end of the upper portion of the clip 41 is curved outwardly and its midsection has a concave depression 42 facing the slot 40 to receive the end plugs 47 of a spindle bar 46 (described hereinafter). A spring steel guide plate 43 is mounted on the outer face of each end plate 23 and 24 and has a flat vertical portion 44 extending perpendicularly outward in alignment with the rear edge of the slot 40, and a forward portion 45 extending forwardly and angularly outwardly from the perpendicular portion. The flat vertical 44 portion and forwardly extending portion 45 serve as a guide for installing the spindle bar 46 (described below).

As best seen in FIGS. 4, 5, and 6, a tubular spindle bar 46 extends transversely between the end plates 23 and 24 and has a low-friction end plug 47 press fitted in each end that are releasably and rotatably received in the vertical slots 40. Each end plug 47 has a rounded outer end 48 and a reduced diameter circumferential groove 49 spaced inwardly from the rounded end. The end plugs 47 and grooves 49 are sized to provide a sufficient frictional fit within the slot 40 to provide a predetermined amount of drag as the spindle bar 46 rotates. The rounded ends 48 of the end plugs 47 are also engaged in the concave depression 42 of the resiliently biased spring clips 41 which rotatably retain the spindle bar and also produces a small amount of drag.

A first or right-hand hub 50 and a second left-hand hub 51 (as viewed in FIG. 4) are slidably received and secured on the spindle bar 46 near each end in opposed facing relation by full dog set screws 52. The right-hand hub 50 is a generally cylindrical member having a central bore 53, a collar portion 54 at one end with a radially extending threaded bore 55 in which the full dog set screw 52 is threadedly engaged, a radial circumferential flange portion 56 larger in diameter than the collar portion, and a cylindrical core receiving portion 57 at its opposite end smaller in diameter than the flange diameter.

The cylindrical core receiving portion 57 has a tapered or beveled end 58 and is sized to be slidably received within one end of a conventional tubular core on which the feed paper or other media is rolled. Commonly, the length of the tubular core of the roll of feed printing media varies slightly depending upon the printing media supplier, and the edge of the rolled printing media is not always flush with the end of the core. Thus, the flange portion 56 is sized to allow the core receiving portion 57 to enter the end of the tubular core such that if the the outer end of the core extends beyond the edge of the rolled printing media, the core will engage the flange portion, or if the outer edge of the rolled printing media extends beyond the edge of the core, the outer edge of the rolled printing media will engage the flange.

The right-hand end of the spindle bar 46 is provided a plurality of circumferentially spaced adjustment holes 59 extending inwardly in a spiral path from near the outer end of the bar, and a series of circumferentially spaced indexing lines 60 extending longitudinally from the right-hand end of the bar toward the holes 59. An opening 61 is formed in the end of the collar portion 54 of the hub 50 to faciliate viewing the lower end of the full dog set screw. This arrangement allows the user to position the flange portion 56 of the hub 50 at a selected incremental distance from the end of the spindle bar 46 and secure it by turning the full dog set screw to engage its lower end in a selected hole 59. Thus, the user can adjust the right-hand hub 50 to compensate for situations where the edge of the rolled printing media is not flush with the end of the core, and assure that the right-hand edge of the printing media is properly aligned with the existing indexing mark on the printer/plotter by moving the hub axially inward or outward on the spindle bar 46.

FIG. 5A shows an alternate embodiment of the right-hand end of the spindle bar 46 which is provided with a shallow circumferential groove 59A extending inwardly in a spiral from near the outer end of the bar, and a series of circumferentially spaced indexing lines 60 extending longitudinally from the right-hand end of the bar toward the groove 59A. This arrangement also allows the user to position the flange portion 56 of the hub 50 at a selected incremental distance from the end of the spindle bar 46 and secure it by turning the full dog set screw to engage its forward in the groove 59A.

The left-hand hub 51 is a generally cylindrical member having a central bore 61, a collar portion 62 at one end with a radially extending threaded bore in which the set screw is threadedly engaged, a radial circumferential flange portion 63 larger in diameter than the collar portion, and a cylindrical core receiving portion 64 at its opposite end smaller in diameter than the flange diameter. The cylindrical core receiving portion 64 has a tapered or beveled end and is sized to be slidably received within one end of the tubular core on which the feed printing media is rolled.

In a preferred embodiment, the right-hand hub 50 is formed of metal, and the left-hand hub 51 is formed of plastic, however, it should be understood that either hub may be formed of any suitable material.

Having described the components of the auxiliary feed printing media holder 20, a description of how it is installated on an existing printer/plotter follows with reference to FIGS. 1, 2, and 7.

The conventional U-shaped wire paper catcher 14 of the existing printer/plotter has a pair of wire arms 14A at each end with eyelets or flat loops 14B at their upper end which are screwed to the inner facing sides of the printer/plotter supporting legs 11A. The upper ends of the rear portion of the U-shaped wire members of the paper catcher 14 are also releasably attached along a crossbar extending between the support legs 11A beneath the housing 13 by a plastic clip or bracket having short depending pins received in holes in the crossbar.

The auxiliary feed printing media holder 20 is furnished as an assembled unit. To install the auxiliary feed printing media holder 20, the wire paper catcher 14 is removed from the printer/plotter by removing the mounting screws of the four upwardly extending wire arms 14A, and removing the plastic clips or brackets along its rear edge from the existing crossbar.

The auxiliary feed printing media holder 20 is then lifted to align the counterbored holes 36 at the upper end of the mounting plates 23 and 24 with the existing paper catcher mounting screw holes in the legs 11A from which the screws were removed, and screws are placed through the counterbored holes 36 in the right-hand end plate 23 and the bushings 37 in the counterbored holes 36 in the left-hand end plate 24 into the existing holes in the legs 11A.

As best seen in FIG. 7, the eyelets or flat loops 14B at the upper end of the wire arms 14A of the paper catcher 14 are then raised upwardly into the shallow rectangular grooves 38 on the outer face of the end plates 23 and 24 to align the holes in the loops with the threaded screw holes 39 at the upper end of the grooves, and screws are installed through the aligned holes. The screws when turned, draw the flat loops inwardly onto the grooves 38 and against the end plates.

The upper ends of the rear portion of the U-shaped wire members of the paper catcher 14 are lifted to a position above the inverted L-shaped angle member 27 extending transversely between the end plates 23 and 24, and the depending pins 70 of the existing plastic clips or brackets 71 are pressed into the holes 28 in the horizontal leg of the angle member.

Thus, the existing paper catcher 14 is replaced and is supported by the auxiliary feed printing media holder 20 in a position slightly lower than its original position (FIG. 2).

The roll 21 of feed printing media is installed with the spindle bar 46 removed from the end plates 23 and 24, and the left-hand hub 51 removed from the spindle bar. The left-hand side of the spindle bar 46 is passed through the tubular core of the roll 21 of feed printing media until the core receiving portion 57 of the right-hand hub 50 enters the core and the flange portion 56 of the hub engages the right-hand end of the printing media roll. The left-hand hub 51 is then slid onto the left-hand end of the spindle bar 46 until its core receiving portion 64 enters the tubular core and its flange portion 63 engages the left-hand end of the printing media roll 21.

The printing media roll 21 and spindle bar 46 are lifted as a unit and the end plugs 47 at each end of the spindle bar are positioned above the guide plates 43 (FIGS. 3 and 4). The printing media roll and spindle bar 46 are then lowered between the guide plates 43 until the grooves 49 of the end plugs 47 enter the vertical slots 40 and their rounded outer ends 48 snap into the concave depressions 42 in the spring steel clips 41 on the outer face of each end plate.

The free end of the rolled feed printing media 12 is then temporarily positioned with its right-hand edge on the existing index mark of the printer/plotter, and visually inspected to determined if it is properly aligned. The right-hand hub 50 is moved to the right or left on the spindle bar 46 as necessary until the right-hand edge of the printing media is properly aligned with the index mark of the printer/plotter, and then the hub 50 is secured by turning the full dog set screw 52 to engage its forward end in the spiral groove 59 on the spindle bar. The left-hand hub 51 is then moved to firmly engage its flange portion 63 on the left-hand end of the printing media roll, and secured by turning its set screw to engage its forward end on the spindle bar 46.

Referring again to FIGS. 1 and 7, the free end of the rolled printing media 12 is then manually passed from the underside of the roll 21, over the first roller 29, under the second roller 30, over the exterior of the existing printing media roll housing 13 of the printer/plotter, and the weight bar 32 is pivoted to engage and rest on the printing media roll 21 beneath the first roller 29 to apply tension on the printing media. The right-hand edge of the printing media 12 is again carefully aligned on the index mark of the printer/plotter, and the free end of the printing media is fed into the existing pinch rollers or gripping mechanism of the printer/plotter, and the calibration process is initiated in the conventional manner.

As the printing media 21 feeds off of the roll 21 and into the printer/plotter, the pivotal weight bar 32 rests on the printing media roll 21 to maintain the proper amount of tension on the printing media to keep it taut and prevent it from becoming slack or unrolling when the feeding stops and as the resistance on the printing media becomes lighter as it reaches the end of the roll.

While this invention has been described fully and completely with special emphasis upon a preferred embodiment, it should be understood that within the scope of the appended claims the invention may be practiced otherwise than as specifically described herein.

I claim:

1. An auxiliary printing media roll holder for use with printer/plotters of the type that are supported on laterally spaced legs and produce engineering or other large drawings on paper, vellum, film and other printing media which is drawn through the printer/plotter mechanism from a roll, comprising:

an elongate longitudinal frame having end plates at opposed ends disposed in laterally opposed relation a sufficient distance apart to be received and mounted transversely between said laterally spaced legs supporting said printer/plotter;

mounting means associated with said end plates for mounting said frame transversely between said laterally spaced legs;

a first longitudinal tubular roller rotatably secured at opposed ends to said end plates, and a second longitudinal tubular roller rotatably secured at opposed ends to said end plates in parallel spaced relation to said first roller;

a longitudinal spindle bar removably received and rotatably engaged at opposed ends on said end plates; and a first hub and a second hub each slidably received and releasably secured on said spindle bar near a respective one of said spindle bar opposed ends in laterally opposed spaced relation and each having a generally cylindrical core receiving portion disposed in opposed facing relation for engaging and supporting opposed ends of a tubular core of a supply roll of printing media;

said frame being mounted transversely between said laterally spaced legs supporting said printer/plotter, and said printing media being drawn from an underside of said supply roll, passing over said first roller, under said second roller, and into the printer/plotter.

2. The auxiliary printing media roll holder according to claim 1, further comprising:

a pair of pivot arms each pivotally mounted at a lower end on a respective opposed facing surface of said end plates in laterally opposed relation; and an elongate longitudinal tubular weight bar secured between upper ends of said pivot arms for pivotal movement therewith to engage said printing media and apply and maintain an amount of tension on said printing media sufficient to keep it taut and prevent it from unrolling when feeding stops and as resistance of the rolled printing media becomes lighter as it reaches the end of said roll.

3. The auxiliary printing media roll holder according to claim 1, wherein said first and second hubs each have a generally cylindrical core receiving portion at one end and an adjacent radial circumferential flange portion larger in diameter than said core receiving portion, said core receiving portion sized to be slidably received within one end of said tubular core, and said flange portion sized to allow said core receiving portion to enter the end of said core such that if the outer end of the said core extends beyond the outer edge of the rolled printing media, said core will engage said flange portion, and if the outer edge of the rolled printing media extends beyond the outer end of said core, the outer edge of the rolled printing media will engage said flange portion; and one of said hubs being adjustably positioned relative to a respective one of said spindle bar opposed ends to align said outer edge of said printing media with an existing indexing mark on said printer/plotter.

4. The auxiliary printing media roll holder according to claim 3, further comprising adjustment indexing means adjacent one of said spindle bar opposed ends for manually positioning said flange portion of a respective said hub received on said one opposed end at a selected distance from said one opposed end by moving said respective hub axially on said spindle bar and securing said respective hub thereto to compensate for situations where the outer edge of the rolled printing media is not flush with the outer end of said tubular core, and to align said outer edge of said printing media with an existing indexing mark on said printer/plotter.

5. The auxiliary printing media roll holder according to claim 4, wherein said adjustment indexing means comprises a series of circumferentially spaced adjustment holes near one of said spindle bar opposed ends extending inwardly in a spiral path, and a series of circumferentially spaced indexing lines extending from the outer end of said one end, each in axial alignment with a respective one of said adjustment holes; and a set screw extending radially through said respective hub engageable with a selected one of said adjustment holes for positioning said flange portion of said respective said hub at a selected distance from said one opposed end and securing said respective hub to said spindle bar to compensate for situations where said outer edge of the rolled printing media is not flush with the end of said tubular core, and to align said outer edge of said printing media with an existing indexing mark on said printer/plotter.

6. The auxiliary printing media roll holder according to claim 4, wherein said adjustment indexing means comprises a shallow circumferential groove near one of said spindle bar opposed ends extending inwardly in a spiral path, and a series of circumferentially spaced indexing lines extending from the outer end of said one end toward said groove; and a set screw extending radially through said respective hub engageable in said groove for positioning said flange portion of said respective said hub at a selected distance from said one opposed end and securing said respective hub to said spindle bar to compensate for situations where said outer edge of the rolled printing media is not flush with the end of said tubular core, and to align said outer edge of said printing media with an existing indexing mark on said printer/plotter.

7. The auxiliary printing media roll holder according to claim 1, further comprising paper catcher mounting and support means on said frame for receiving and supporting a paper catcher that receives the printing media as it exits the printer/plotter.

8. The auxiliary printing media roll holder according to claim 1, wherein said end plates are secured in laterally opposed spaced apart relation by longitudinal spacer bars, and each said end plate has a generally vertical slot open at an upper end;

said longitudinal tubular spindle bar has end plugs of low friction material extending from said opposed ends removably received and rotatably engaged in a respective said vertical slot in said end plates; and a resilient clip is mounted on an outer facing surface of each said end plate adjacent each said vertical slot configured to resiliently engage an outer end of said end plugs and rotatably maintain said spindle bar in said vertical slots.

9. The auxiliary printing media roll holder according to claim 8, further comprising a resilient guide plate mounted on said outer facing surface of each said end plate adjacent the open upper ends of said slots configured to guide said end plugs extending from opposed ends of said spindle bar into said vertical slots when installing said spindle bar.

10. A method for increasing the printing/plotting capacity of printer/plotters of the type that are supported on laterally spaced legs and reducing downtime due to reloading rolls of feed printing media, comprising the steps of:

providing an auxiliary printing media roll holder having a longitudinal frame with end plates at opposed ends, a first and second longitudinal roller rotatably mounted at opposed ends between said end plates in parallel spaced relation, a longitudinal spindle bar removably received and rotatably engaged at opposed ends on said end plates, and a first hub and a second hub each slidably received and releasably secured on said spindle bar near a respective one of said spindle bar opposed ends in laterally opposed spaced relation and each having a generally cylindrical core receiving portion disposed in opposed facing relation for engaging and supporting opposed ends of a tubular core of a roll of printing media;

installing said frame transversely between said laterally spaced legs supporting said printer/plotter;

installing a roll of printing media wound on a tubular core on said spindle bar hubs;

installing said spindle bar and said roll of printing media on said frame; and feeding said printing media from an underside of said roll, over said first roller, under said second roller, and into said printer/plotter.

11. The method according to claim 10, comprising the steps of:

prior to feeding said printing media from said roll, positioning one of said hubs relative to a respective one of said spindle bar opposed ends to align an outer edge of said printing media with an existing indexing mark on said printer/plotter; and applying drag and tension on said printing media sufficient to keep it taut and prevent it from unrolling when feeding stops and as resistance of the rolled printing media becomes lighter as it reaches the end of said roll.

12. The combination of a printer/plotter and an auxiliary printing media roll holder, comprising:

a printer/plotter supported on laterally spaced legs and having an internal printer/plotter mechanism for drawing paper, vellum, film and other printing media from a roll to produce engineering or other large drawings;

an elongate longitudinal frame mounted transversely between said laterally spaced legs and having end plates at opposed ends disposed in laterally opposed relation;

a first longitudinal tubular roller rotatably secured at opposed ends to said end plates, and a second longitudinal tubular roller rotatably secured at opposed ends to said end plates in parallel spaced relation to said first roller;

a longitudinal spindle bar removably received and rotatably engaged at opposed ends on said end plates; and a first hub and a second hub each slidably received and releasably secured on said spindle bar near a respective one of said spindle bar opposed ends in laterally opposed spaced relation and each having a generally cylindrical core receiving portion disposed in opposed facing relation for engaging and supporting opposed ends of a tubular core of a supply roll of printing media;

said printing media being drawn from an underside of said supply roll, passing over said first roller, under said second roller, and into said printer/plotter.

* * * * *